US007168907B2

(12) United States Patent
Lyons et al.

(10) Patent No.: US 7,168,907 B2
(45) Date of Patent: Jan. 30, 2007

(54) LATCHING SYSTEM FOR AUTOMATICALLY SECURING FRONT-MOUNTED LOADER MAST TO TRACTOR-CARRIED LOADER MOUNTING FRAME

(75) Inventors: Russell George Lyons, Welland (CA); Radu Traian Guja, Welland (CA)

(73) Assignee: Deere & Company, Moline, IL (US)

( * ) Notice: Subject to any disclaimer, the term of this patent is extended or adjusted under 35 U.S.C. 154(b) by 51 days.

(21) Appl. No.: 11/119,864

(22) Filed: May 2, 2005

(65) Prior Publication Data

US 2006/0245899 A1 Nov. 2, 2006

(51) Int. Cl.
*E02F 3/627* (2006.01)

(52) U.S. Cl. ..... 414/686; 172/274

(58) Field of Classification Search ..... 414/686; 172/272–275

See application file for complete search history.

(56) References Cited

U.S. PATENT DOCUMENTS 5,387,075 A 2/1995 Aoki
5,620,297 A 4/1997 Mahaney
6,386,821 B1 5/2002 Schneider

FOREIGN PATENT DOCUMENTS

GB 2 131 391 11/1983

*Primary Examiner*—Donald Underwood

(57) ABSTRACT

The masts of a front-end loader are releasably attached to vertical plates of a loader mounting frame located at the opposite sides of a tractor by latch hooks pivotally mounted to the masts and engaged with latching elements carried by the vertical plates. An over center biasing arrangement acts on each latch hook and acts to bias the latch hook to a closed position, but moves over center when the latch is manually opened so as to bias the latch to its open position. The pins pivotally coupling the latches to the masts also serve to couple the piston rods of a pair of loader boom lift cylinders to the masts. Extension of the cylinders during detaching the masts from the vertical plates causes the opened latch hooks to be pivoted to the extent that the biasing elements move over center and reset the latches to their closed positions, which positions are conducive for automatically reattaching the mast to the vertical plates.

10 Claims, 11 Drawing Sheets

LATCHING SYSTEM FOR AUTOMATICALLY SECURING FRONT-MOUNTED LOADER MAST TO TRACTOR-CARRIED LOADER MOUNTING FRAME

FIELD OF THE INVENTION

The present invention relates to front-mounted loaders, and, more specifically, relates to a latching system for attaching such a loader to a tractor.

BACKGROUND OF THE INVENTION

Most current known loader latching systems require an operator to remove or to install pins to disconnect or attach the loader to the tractor and/or have latching systems that are complex and unreliable. United Kingdom Patent Application GB 2,131,391 A, published 20 Jun. 1984 discloses a loader boom comprising a pair of arms having respective masts pivotally attached to their rear ends and having a hydraulic boom lift cylinder coupled between each mast and arm for effecting raising and lowering of the arms of a mounted loader. A latching system is provided for respectively attaching the pair of masts to a pair of loader support frame plates joined to opposite sides of the tractor frame. The latching system includes a bushing and spring-biased latch hook carried by each mast, and a bushing receptacle provided in the top of, and a latch block fixed to, each frame plate. Mounting of the loader to the tractor is effected by manipulating the masts such that their respective bushings enter an associated one of the support plate bushing receptacles and such that the spring-biased latch hooks engage a deflecting surface of an associated one of the latch blocks and are deflected to respective positions permitting the latch hooks to move over the latch blocks, with the latch hooks then moving to respective latched positions wherein the latch hooks are engaged with respective notches provided in the latch blocks.

A drawback of the loader latching system disclosed in the published United Kingdom application is that, when disconnecting the loader from the tractor, an operator must manually move the latch hooks to respective unlatched positions and hold them in their unlatched positions while manipulating hydraulic controls for operating the boom lift cylinders to effect disconnection of the loader masts from the frame plates.

SUMMARY OF THE INVENTION

According to the present invention, there is provided an improved latching system for securing a loader to a tractor.

An object of the invention is to provide a latching system which is a simple robust system, including latch hooks which automatically latch the loader to the tractor during installation, and which automatically remain in open positions so as not to require the attention of the operator at a time when the operator is controlling operation of the boom lift cylinders in order to disconnect the loader from the tractor.

A further object of the invention, is to provide a latching system, as set forth in the foregoing object, wherein the latch hooks are automatically reset to a closed position, during disconnecting the loader from the tractor, such closed position being that required for later attaching the loader to the tractor.

These objects are accomplished by a latching system wherein an over center biasing arrangement is associated with each latch hook for resisting movement of the latch from its latched position, but permitting the latch hook to be manually moved to the extent that the biasing arrangement moves over center and biases the latch hook to an open position. Further, the latch hook is mounted in such relationship to the loader boom lift cylinder that, during the extension of the cylinder, when detaching the loader mast from the tractor, the cylinder rod acts to reset the latch hook to its closed position, which is required for attaching the loader to the tractor.

These and other objects of the invention will become apparent from a reading of the ensuing description together with the appended drawings.

DESCRIPTION OF THE PREFERRED EMBODIMENT

Figure 1:
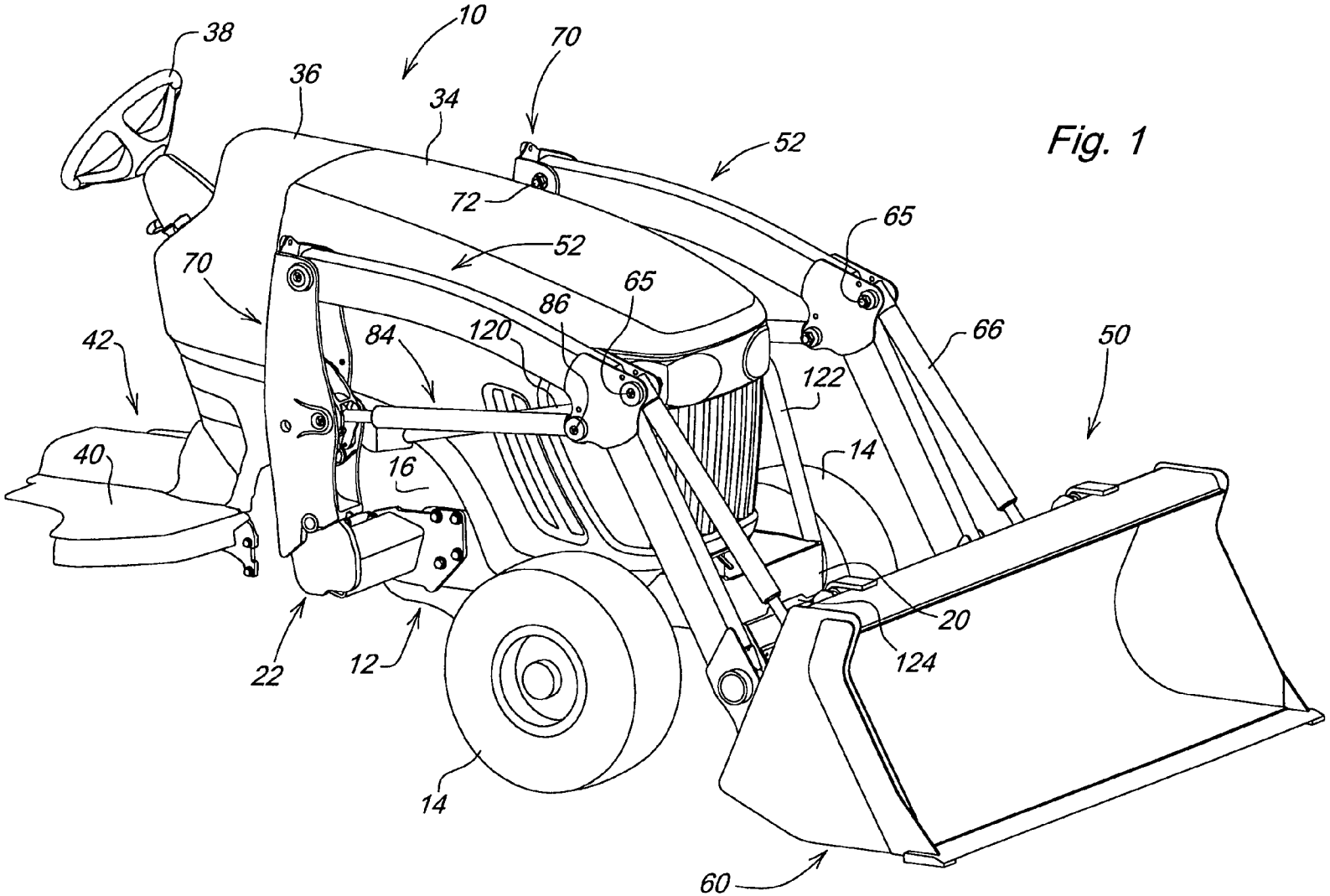
FIG. 1 is a right front perspective view of a forward end portion of a tractor equipped with a loader mounting frame and on which is mounted a front-end loader equipped with a latching system constructed in accordance with the principles of the present invention.
Figure 2:
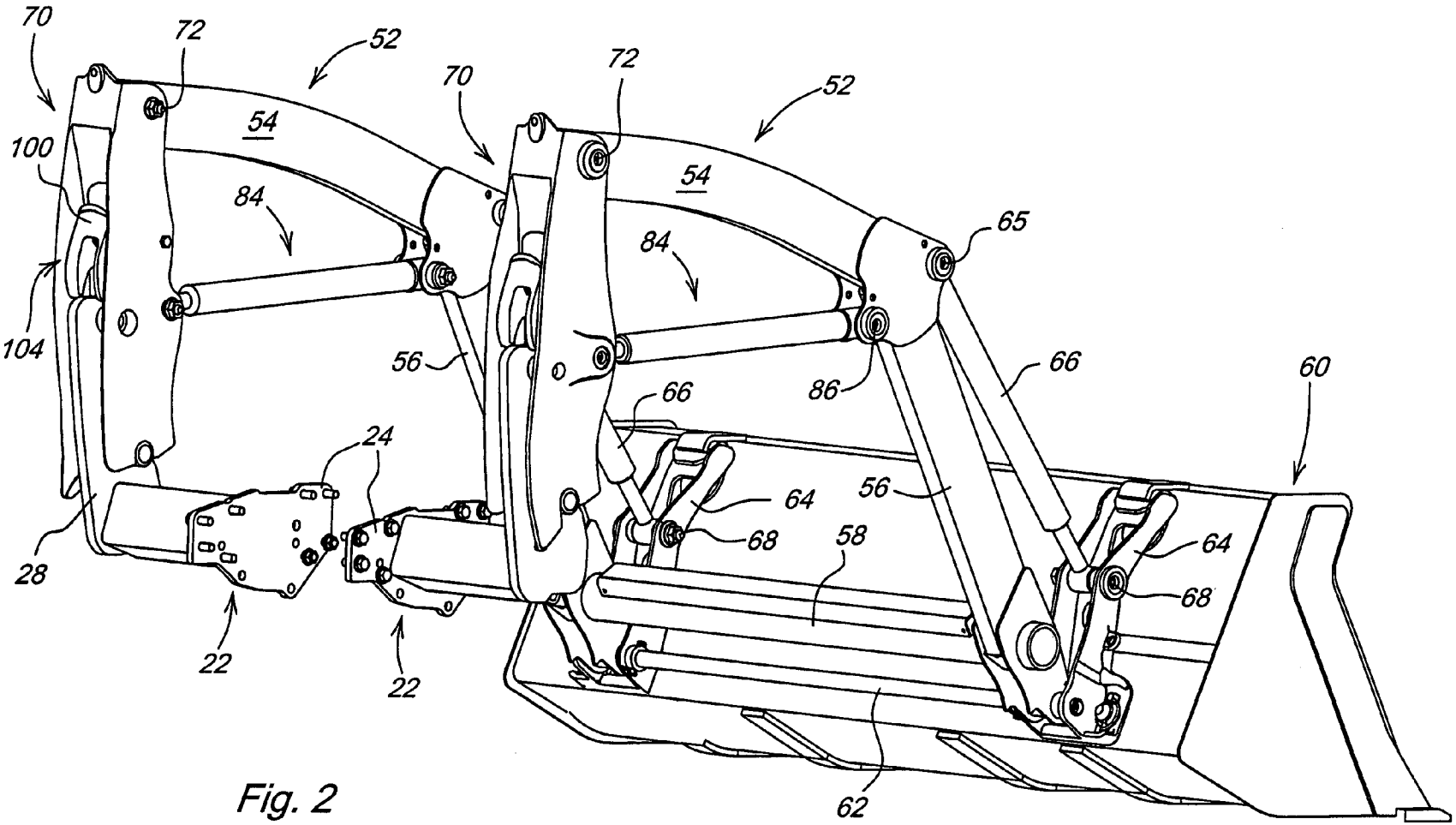
FIG. 2 is a right rear perspective view showing the loader of FIG. 1 mounted on the loader mounting frame, but omitting the remainder of the tractor and the parking stand for the sake of clarity.
Figure 3:
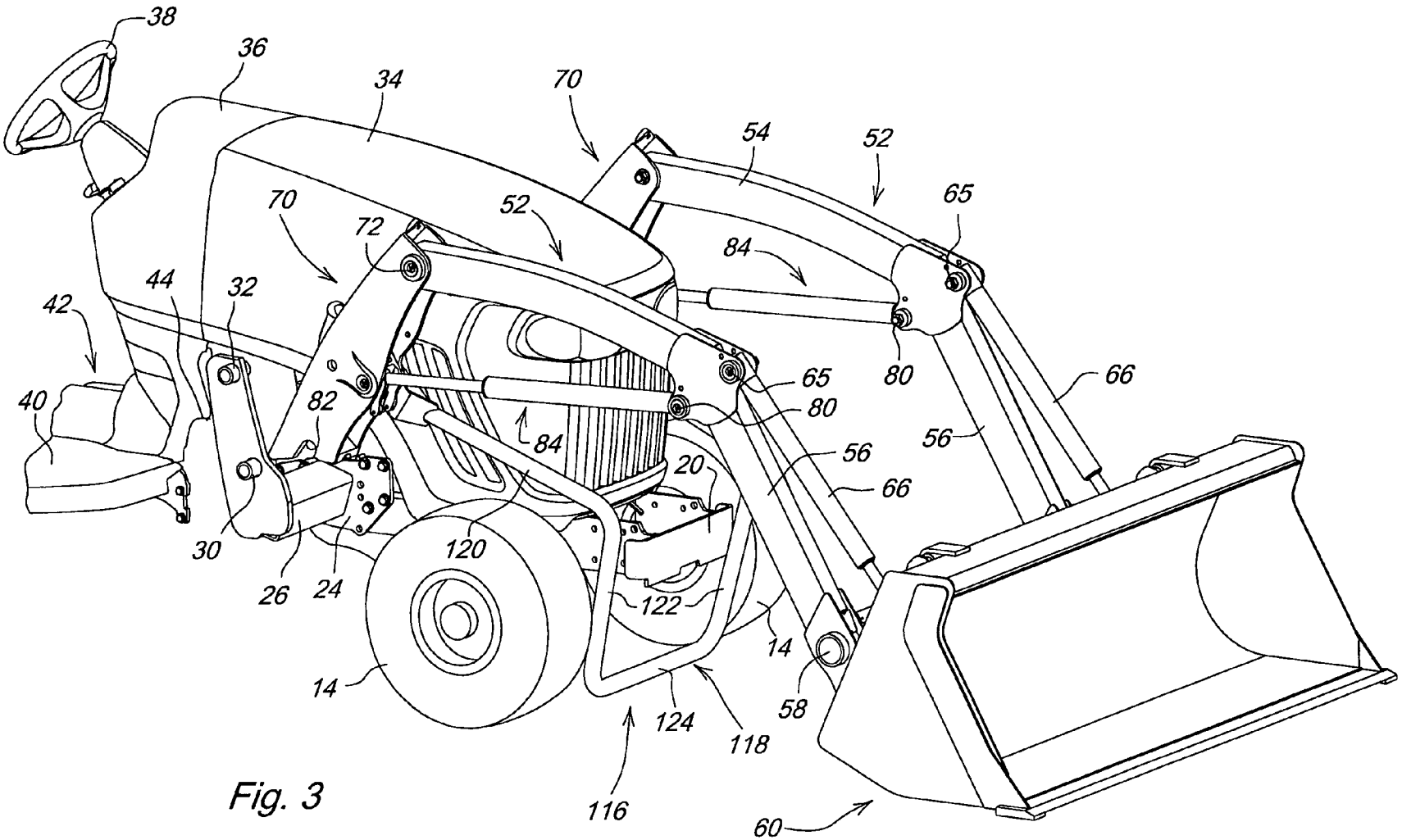
FIG. 3 is a right front perspective view of the loader and tractor of FIG. 1, but showing the loader in a parked position.

Referring now to FIGS. 1–3, there is shown a front end of a mobile vehicle, here shown as being a tractor 10, and a front-end loader 50 mounted on the tractor.

The tractor 10 includes a main frame 12 supported for movement over the ground by a pair of rear wheels (not shown) and a pair of front wheels 14, here shown as being drive wheels. The frame 12 includes a pair of fore-and-aft extending, parallel, transversely spaced, side members 16 (only the right side member being visible) joined at their forward ends by a cross member and to a forward region of which is mounted a front ballast weight bracket 20. A pair of loader support frames 22 are respectively provided at the opposite sides of the tractor 10, with each including a vertical mounting plate 24 bolted to an associated side member 16 and joined to an inner end of a horizontal, outwardly projecting tubular member 26 having its outer end joined to an inner surface of a lower region of a vertical plate 28. Projecting through and fixed to the vertical plate 28 so as to have opposite end sections exposed at opposite sides of the plate 28 are a bottom cylindrical bushing 30, located at a height just above the tubular member 26, and a top cylindrical bushing 32, located at an upper region of the plate 28, the bushings 30 and 32 serving in the connection of the loader 50 to the tractor 10 in a manner described below.

A hood 34 extends forwardly from a control console 36 and covers an engine supported on a forward section of the frame 12. A steering wheel 38 is provided at the control console 36 for being easily reached by a seated operator having his or her feet in engagement with a foot rest zone 40 of a floor pan or platform 42. It is noted that a forward region of the foot rest zone 40 is inclined upward toward the front and terminates at a top surface 44 (FIG. 3), which is at a height approximately half way between the bottom bushing 30 and the top bushing 32, the significance of this position being explained below.

The loader 50 includes a boom structure comprising a pair of parallel loader boom arms 52, each having rear and front sections 54 and 56, respectively, of approximately equal length, with the rear section 54 being joined to the front section 56 so as to define an included angle of approximately 135°. As viewed with the loader in a lowered position, as shown in FIGS. 1 and 3, the arm rear sections 54 are curved slightly downwardly from rear to front, while the arm front sections 56 extend downwardly to respective forward end regions that are joined together by a tubular cross member 58 (FIG. 3). A working tool or implement, here shown as a loader bucket 60 is coupled to the forward end of the loader boom arms 52 by a horizontal cross rod 62 that is received in aligned bushings provided in the arms, and in aligned bushings provided in lower regions of a pair of transversely spaced brackets 64 (FIG. 2) fixed to the back side of the bucket 60. The bucket 60 is thus coupled to the boom arms 52 for pivoting about a horizontal transverse axis. Coupled, as by a pin 65, to each of the boom arms 52 at an upper region of the junction between the front rear arm sections 54 and 56 is the barrel of a hydraulic bucket tilt cylinder 66 having a rod pivotally coupled, as by a pin 68, to an upper region of an associated one of the brackets 64. Extension and retraction of the bucket tilt cylinders 62 will result in the bucket 60 being tilted one way or the other about its pivotal connection with the loader boom arms 52.

Figure 4:
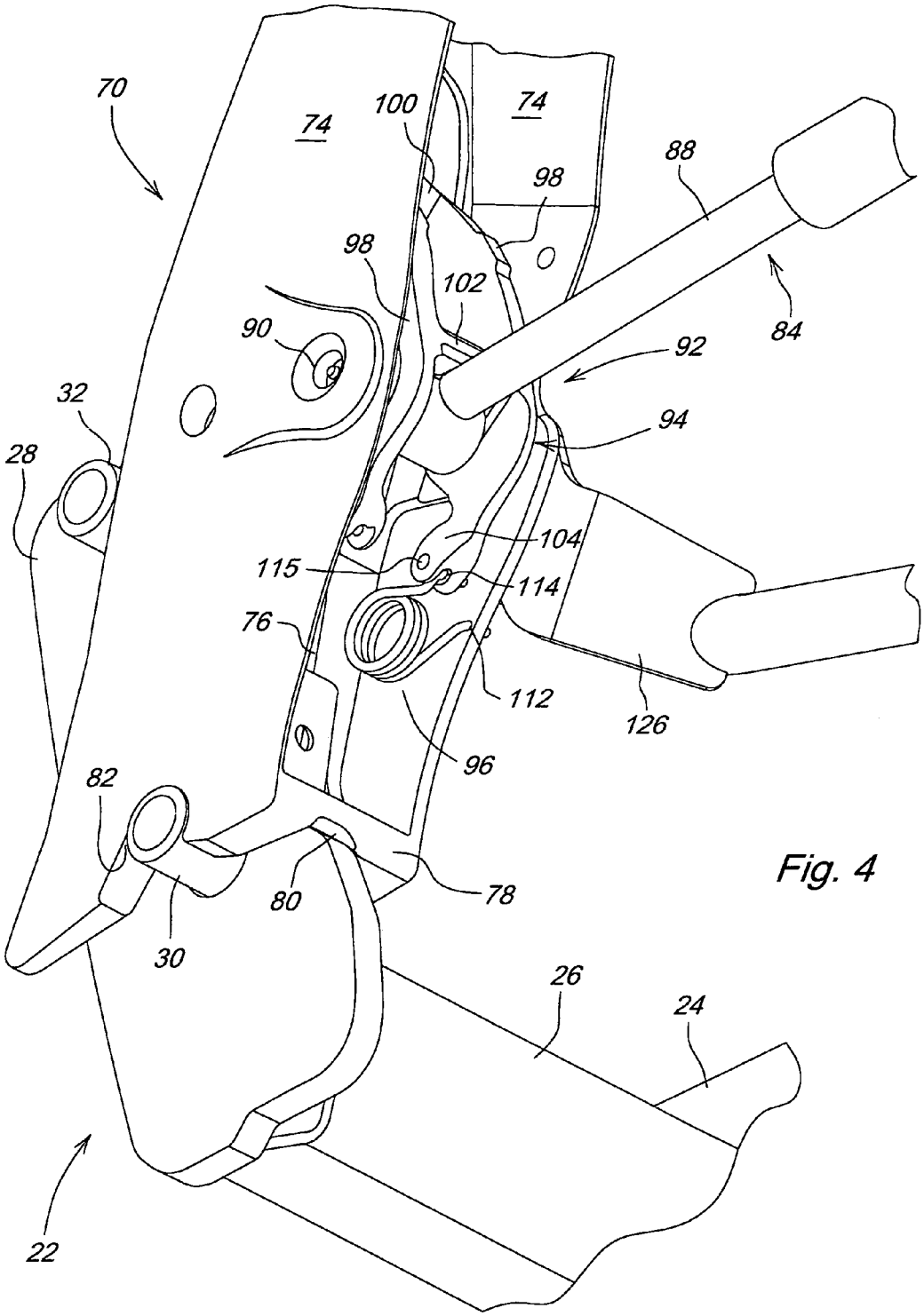
FIG. 4 is a lower, right front perspective view of the mast and loader support frame, with the mast being shown rocked forwardly to a position it would occupy just before becoming separated from the loader support frame, as shown, in FIG. 3.

Upper ends of a pair of loader masts 70 are respectively pivotally coupled, as at pins 72, to rear ends of the loader boom arms 52. Referring now also to FIG. 4, it can be seen that the loader masts 70 are each constructed of a pair of parallel plates 74 joined together by a rib structure 76. The bottom ends of the plates 74 are joined together by a web 78 containing a fore-and-aft extending centering or guide groove 80 in which is located a forward edge portion of the loader support frame plate 28. A bushing receptacle 82 is provided in the bottoms of each of the plates 74 and received in the receptacle is the opposite end portions of the lower cylindrical bushing 30. It is to be noted that the cylindrical bushing 30 could be replaced by any pivot-defining support which would cooperate with a complementary receptacle in the bottom of the mast 70 so as to allow the mast to pivot about the support when the loader 50 being attached to, or detached from, the tractor 10, as is described in more detail below.

Coupled between each of the boom arms 52 and the associated mast 70 is a boom lift cylinder 84 having a barrel coupled, as by a pin 86, to a bracket provided at an underside of the junction between the rear and front sections 54 and 56, respectively, of the boom arms. A rod 88 of the lift cylinder 84 has an end defined by an eye which is located between, and coupled to, the mast plates 74 by a pin 90 at a location approximately midway between opposite ends of, and at a forward region of, the mast 70.

Located between the pair of plates 74 of each loader mast 70 is a latch assembly 92 comprising a latch hook 94 and a coil torsion spring 96. The latch hook 94 is mounted for pivoting about the pin 90 and includes a pair of parallel, transversely spaced, side members 98 located on opposite sides of the eye of the cylinder rod 88. The side members 98 have respective rear ends joined together by a first rib defining a toe pad 100, and by a second rib defining an abutment 102 having a function described below. Forward ends of the side members 98 extend beyond the pin 90 and terminate in bifurcated ends 104. Referring now also to FIGS. 5–11, it can be seen that the underside of each side members 98 of the latch hook 94 forms a downwardly opening latch element receptacle 106 bounded at its rear by a hook nose 108 having a smoothly curved rear surface 110.

Figure 5:
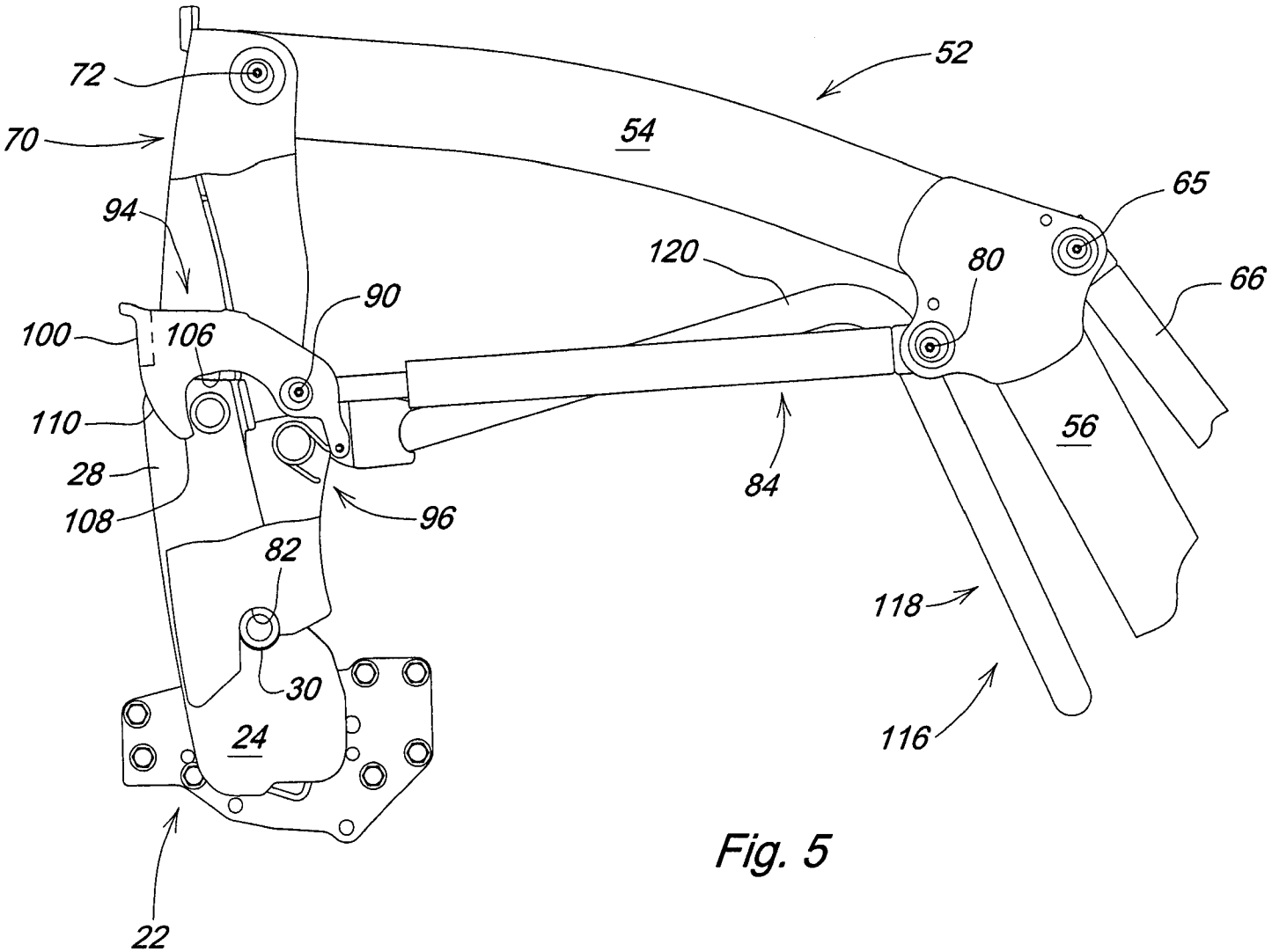
FIGS. 5–8 are right side views of the right-hand mast and loader support frame, with portions removed for clarity, showing a sequence of positions assumed by the loader latch system during detaching the loader from the tractor.
Figure 6:
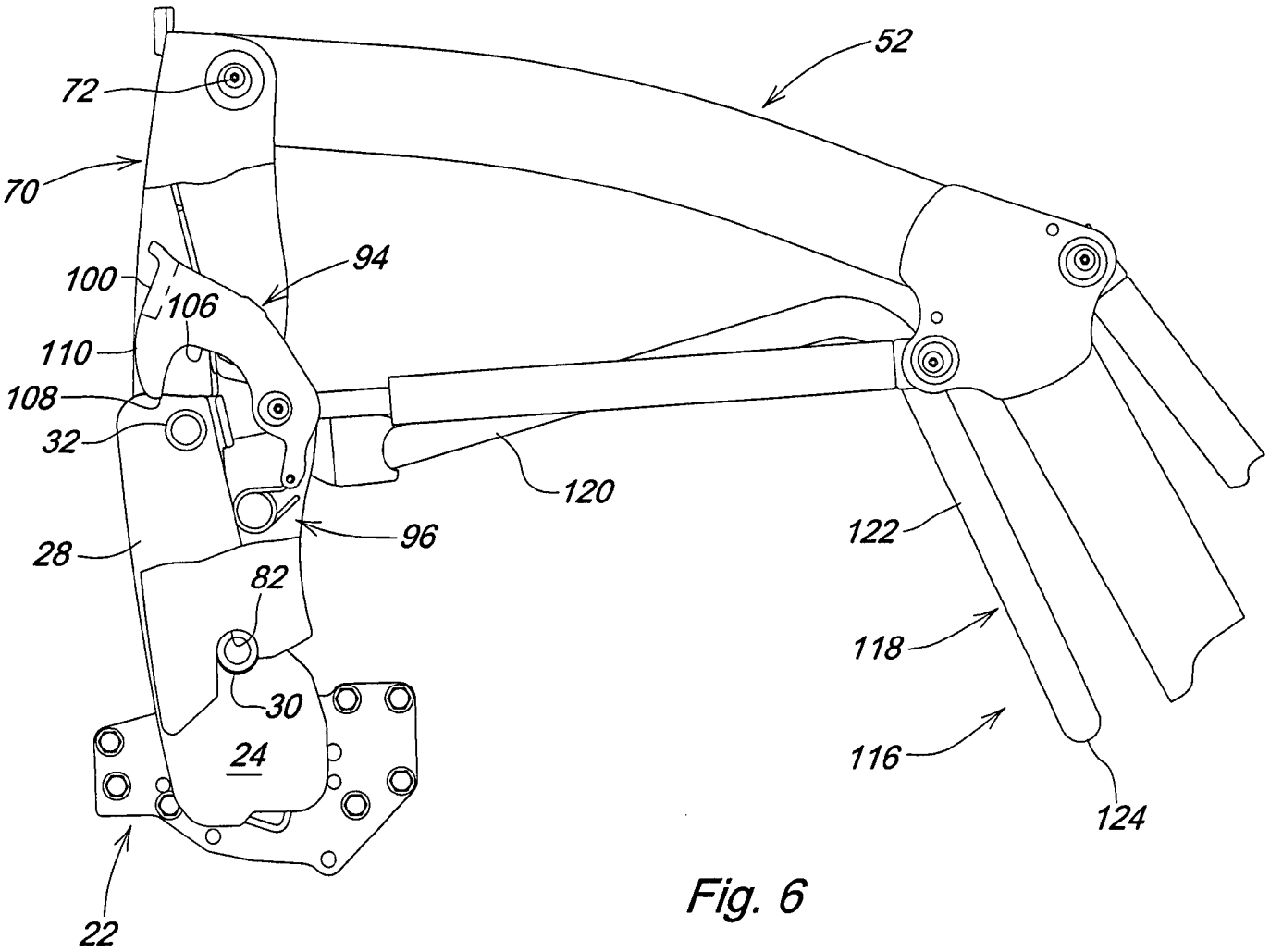
Figure 7:
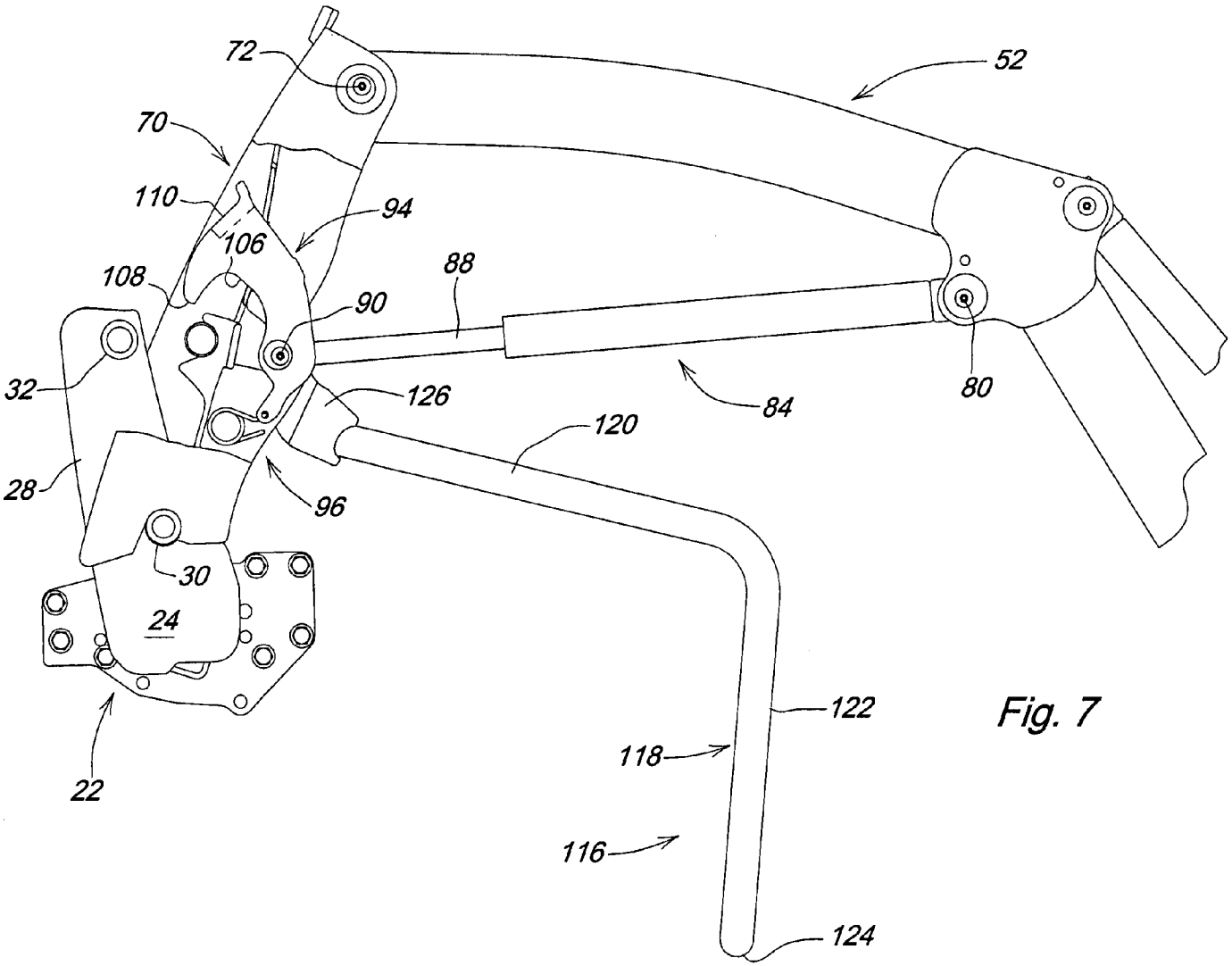

The coil torsion spring 96 includes a central coil section disposed about a transverse axis and joined to an inwardly bent inner end 112 and an outer end bent to form an eye 114. The inner end 112 is received in a hole provided in, and thus is anchored to, the inner plate 74 of the mast 70 at a location in the vicinity of the bifurcated end 104 of the latch hook inner side member 98, while the eye 114 of the torsion spring 96 is received between the furcations of the inner latch side 98 and held in place by a cross pin 115 extending through a transverse bore provided in the bifurcated end 104. The torsion spring 96 is wound such that a spring force exists trying to separate the inner end 112 and the eye 114. When the loader 50 is mounted on the tractor 10, as shown in FIGS. 1 and 2, the line of force acting between the inner end 112 and the eye 114 is forward of the axis of the pin 90 resulting in the spring 96 acting to bias the latch hook 94 to a closed position, as shown in FIG. 5. When the latch hook 94 is manually moved clockwise from its latched position to the open position shown in FIG. 6, the line of action of the spring 96 will go over center so as to be rearward of the axis of the pin 90, the spring 96 then acting to hold the latch hook 94 in an open position wherein the abutment 102 engages the rod 88 of the boom lift cylinder 84, as can best be seen in FIG. 4. While the coil torsion spring 96 is preferred because of being compact so as to easily fit into the space between the mast sides 74, another biasing element such as a coil tension spring or gas cylinder could be used provided it is arranged so as to go over center for biasing the latch hook 94 both closed and open. Furthermore, the biasing element does not have to be coupled directly to the latch hook 94. For example, the biasing element could be connected for transferring force to the latch hook 94 by a lever, linkage, cable, etc.

A parking stand 116 is provided for supporting the rear end of the loader on the ground when the loader is parked, as shown in FIG. 3. The parking stand 116 is constructed of a tube bent to form an arm 118 having respective parallel, fore-and-aft extending rear arm sections 120 having forward ends joined to front arm sections 122, which extend downwardly from, and form an included angle of approximately 90° with, the front arm sections. Lower ends of the front arm sections 122 are joined to each other by a transverse arm section 124. The rear arm sections 120 of the parking stand 116 are disposed approximately perpendicular to, and have rear ends fixed to inner surfaces of the inner plates 74 of the masts 70, in the regions of the pivot pins 90 by mounting members 126. As can be seen in FIG. 1, the transverse arm section 124 is located beneath the front-end weight mounting bracket 20 when the loader 50 is mounted on the tractor 10.

The operation of the latching system is set forth below. Starting with the loader 50 mounted on the tractor 10, as shown in FIGS. 1 and 5, each latch hook 94 will be in its latched position with the associated loader mounting bushing 32 being captured within the latching element receptacle 106. Further, the parking stand 116 will be in an elevated, non-working position, wherein the transverse section 124 is located in a space under the front-end weight bracket 20. If it is desired to disconnect the loader 50 from the tractor, the operator will cause the lift cylinders 84 to be contracted so as to cause the loader boom arms 52 to lower and place the bucket 60 on the ground. The seated operator will then use his or her feet to apply a force to the toe pad 100 of each latch hook 94 to effect clockwise rotation of the latch members 94 about the pins 90, with it being noted that the toe pads 100 are just above the front top edge 44 of the foot rest 40 so as to be within easy reach of the operator's feet. Once the line of force of each of the coil torsion springs 96 moves over center, the torsion springs will act to bias the latch members 94 to their open positions, shown in FIG. 6, wherein the abutment members 102 are in engagement with the piston rods 88 of the lift cylinders 84.

Figure 8:
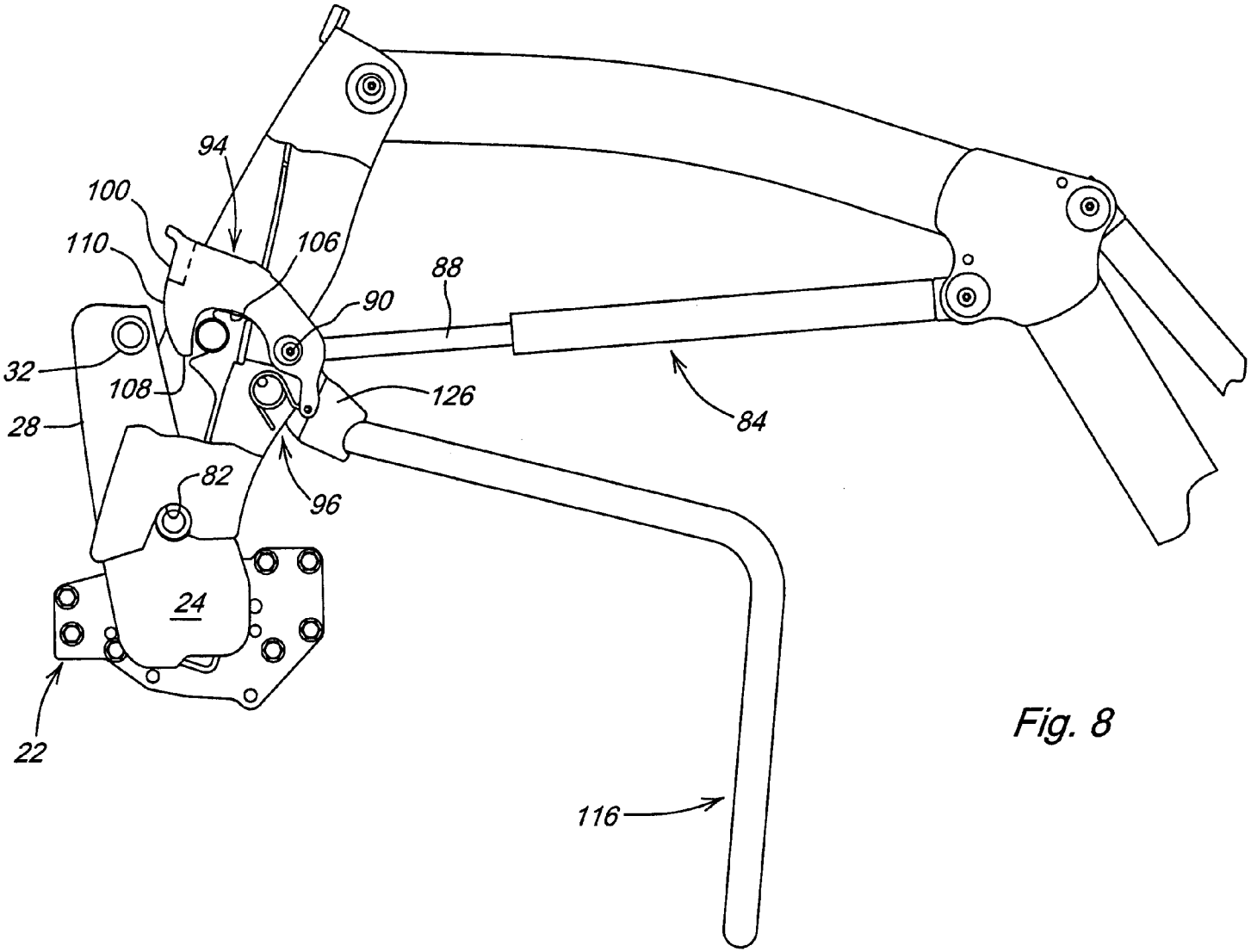

With the latches 94 in their open positions, the parking stand 116 is lowered by extending the hydraulic lift cylinders 84 so as to cause the masts 70 to pivot forward about the loader mounting frame lower bushings 30, with the bucket 60 being slid forwardly on the ground to permit this movement. As masts 70 are pivoted by the extending lift cylinders 84, the transverse section 124 of the parking stand arms 118 will first come into contact with the ground and will, upon further extension of the lift cylinders 84, elevate the masts 70 sufficiently to disengage the bushing receptacles 82 from the respective bushings 30. At the same time, the rods 88 of the hydraulic lift cylinders 84 will, through their contact with the abutments 102 of the latches 94, cause the latches 94 to pivot counterclockwise about the pins 90 a sufficient distance to once again move the lines of action of the torsion springs 96 over center so that the torsion springs 96 act to rotate the latches further counterclockwise to reset them to an attach position, as shown in FIG. 8, which is conducive for the reattachment of the loader 50 to the tractor 10. The disconnection of the loader 50 from the tractor 10 is then completed by disconnecting the hydraulic lines (not shown) coupled between the tractor hydraulic system and the loader. The tractor 10 will then be free of the loader 50, as shown in FIG. 3, and can then be backed away from the loader.

Figure 9:
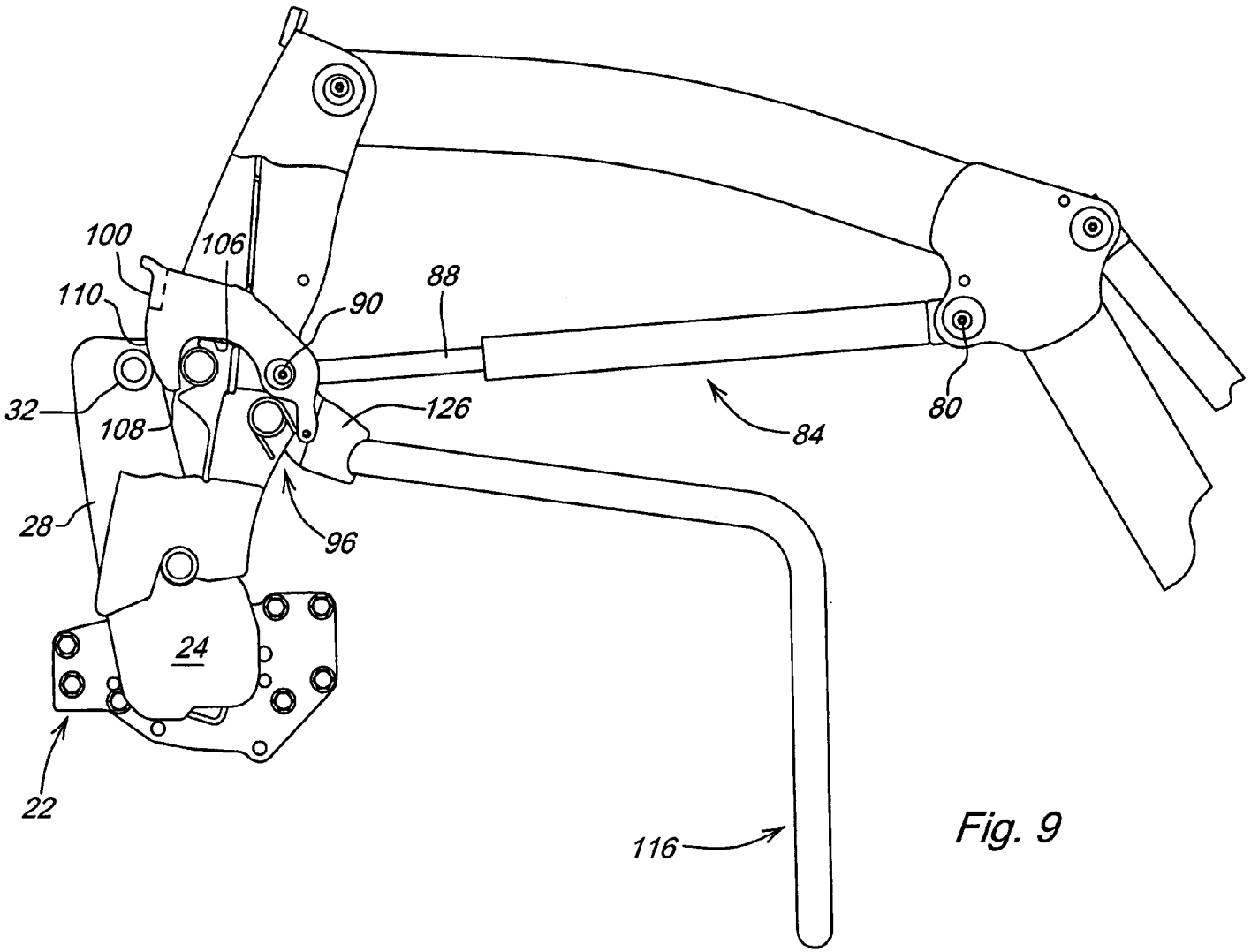
FIGS. 9–11 are right side views of the mast and loader support frame, shown in FIGS. 5–8, but showing a sequence of positions, following that shown in FIG. 8, for reattaching the loader mast to the loader support frame.
Figure 10:
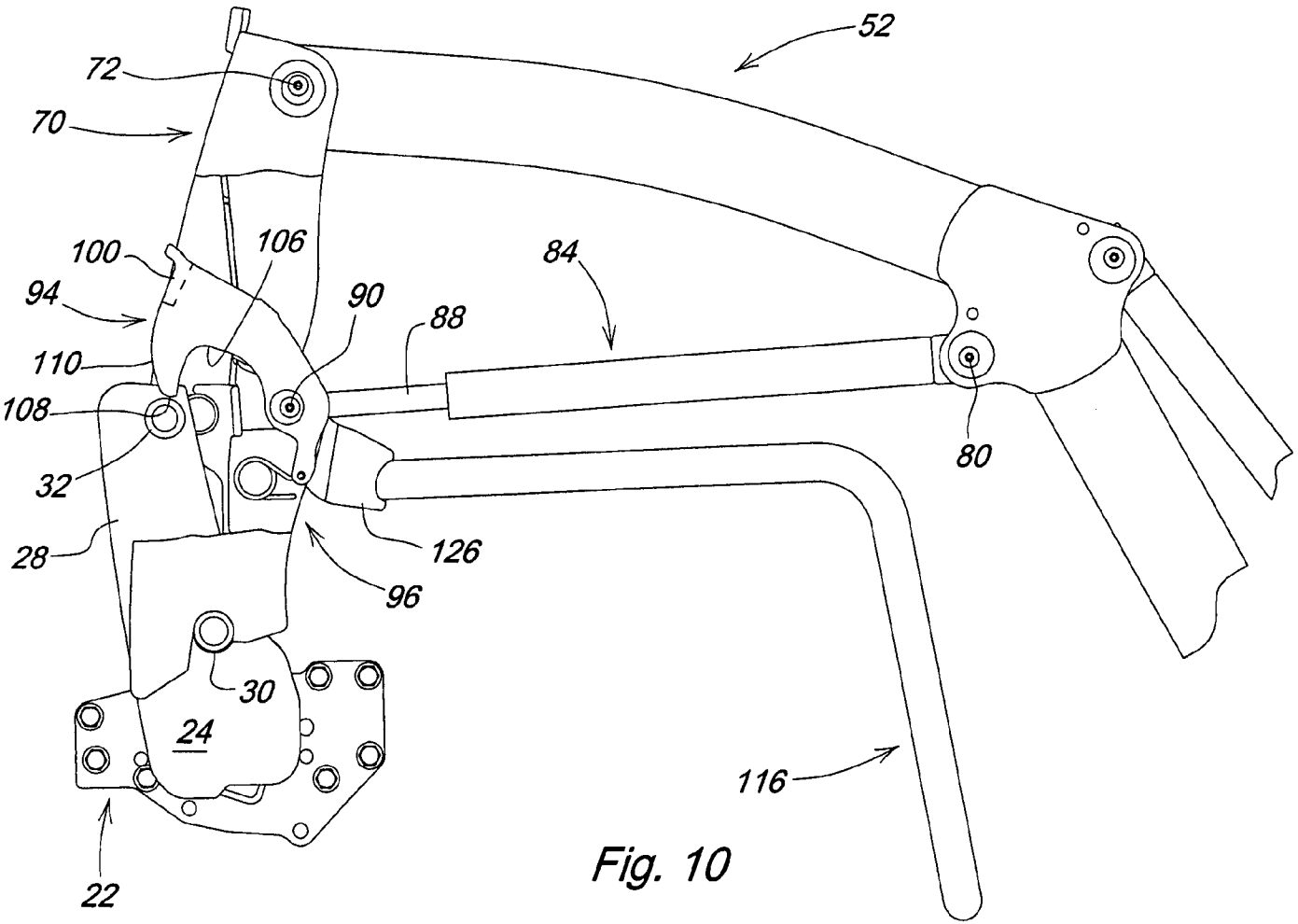
Figure 11:
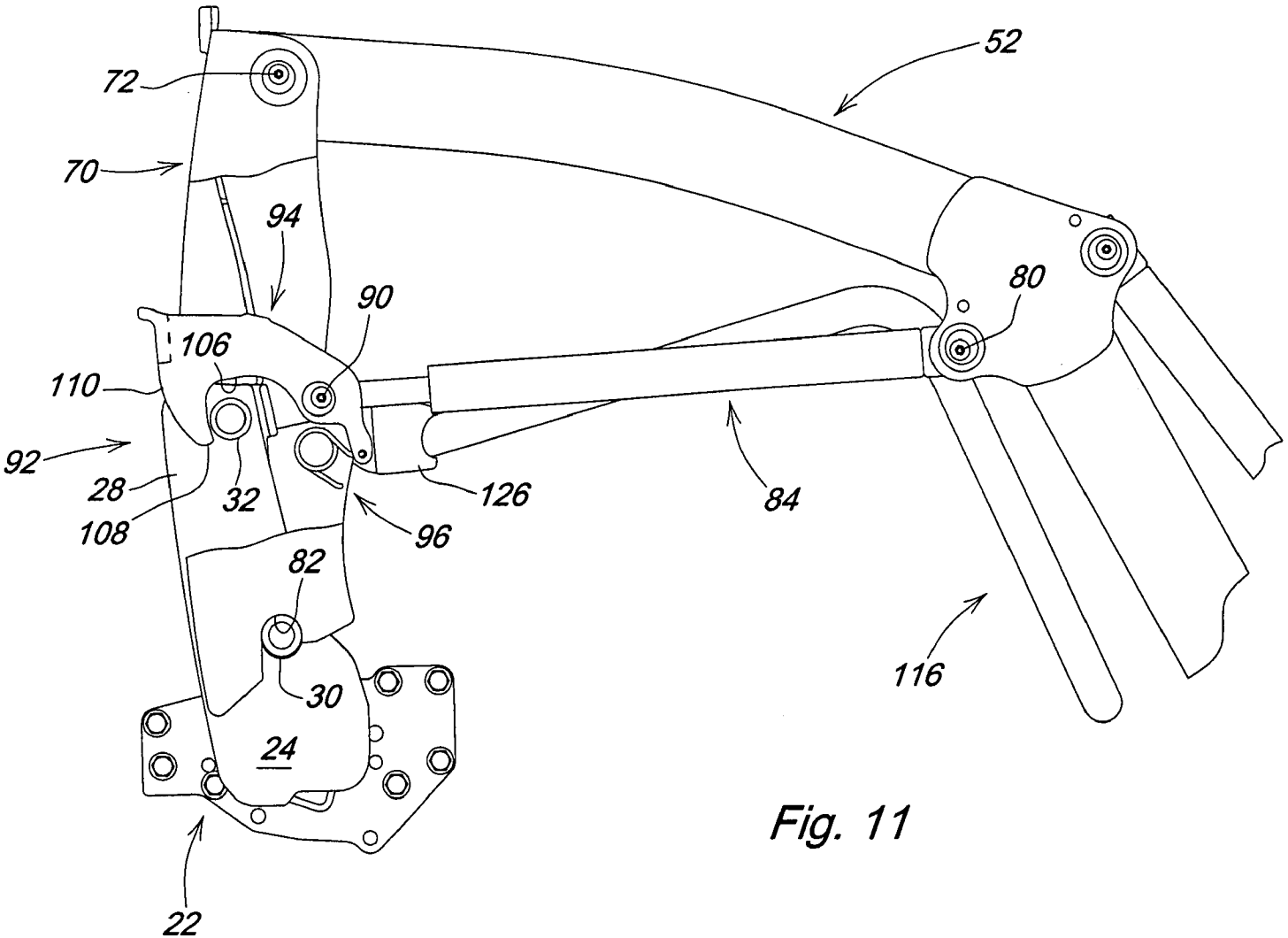

If it is desired to once again attach the loader 50 to the tractor 10, the tractor will be driven between the masts 70 and boom arms 52 to a position approximately like that shown in FIG. 3. The hydraulic system of the tractor 10 will then be connected to the loader 50 and the lift cylinders 84 will be contracted so as to lower the bottom ends of the masts 70 onto the bushings 30, the guidance of the masts 70 into place being facilitated by the front edges of the vertical plates 28 of the loader mounting frames 22 and the grooves 80 in the bottoms of the masts 70. Once the bushings 30 are received within the receptacles 82, further contraction of the lift cylinders 84 will rotate the masts 70 counterclockwise about the bushings 30 so as to bring the lower portions of the smooth rear surfaces 110 of the latches 94 into engagement with the upper bushings 32, as shown in FIG. 9. Still further contraction of the lift cylinders 84 results in the latches 94 moving up and over the upper bushings 32, as shown in FIG. 10, with the torsion springs 96 then acting to move the latches 84 into their latched positions, as shown in FIG. 11.

Thus, it will be appreciated that the over center action of the torsion springs 96 makes it possible, during detaching the loader 50 from the tractor, for the operator to concentrate on effecting operation of the lift cylinders 84 once the latches 94 are manually opened, and that thereafter the latches 94 are automatically reset to a latch position so as to be ready for reattachment of the loader 50 to the tractor 10, and that during this reattachment the latches are automatically moved to their latched positions.

Having described the preferred embodiment, it will become apparent that various modifications can be made without departing from the scope of the invention as defined in the accompanying claims.

The invention claimed is:

1. In a combination of a tractor a loader releasably mounted on said vehicle, said loader including a pair of lift arms disposed on opposite sides of said tractor and having rear ends respectively pivotally attached to upper ends of a pair of masts, a pair of hydraulic lift cylinders respectively being coupled between each arm and mast at opposite sides of said tractor, a pair of loader support frames respectively fixed to opposite sides of said tractor and respectively including a pair of upright support members, said pair of upright support members respectively including a pair of transversely extending pivot-defining elements and respectively including a pair of transversely extending latching elements, said pair of masts respectively including a pair of downwardly opening receptacles received on said pair of pivot-defining elements of said upright support members and including a pair of latch hooks mounted for pivoting between closed and open positions, said latch hooks being in said latched positions and including latch element receptacles receiving said pair of latching elements, and a pair of biasing arrangements respectively associated with said pair of latch hooks and resiliently resisting movement of said pair of latch hooks from said closed positions, the improvement comprising: each of said pair of biasing arrangements being coupled to an associated one of said pair of latch hooks so as to define an over center relationship relative to a pivot axis of said one of said pair of latch hooks, whereby movement of said one of said latch hooks toward said open position from said closed position will result in said biasing arrangement going over center so as to resiliently retain said latch hook in said open position.

2. The combination, as defined in claim 1, wherein each of said pair of biasing arrangements includes a coil torsion spring having opposite first and second ends respectively connected to an associated one of said pair of masts, and to an associated one of said pair of latch hooks.

3. The combination, as defined in claim 1, wherein said pair of pivot-defining elements are each a first cylindrical bushing, and wherein said pair of latching elements are each a second cylindrical bushing.

4. The combination, as defined in claim 1, wherein said pair of hydraulic lift cylinders at each side of said tractor are respectively so located relative to an adjacent one of said pair of latch hooks, that after the latch hook has been manually moved to said open position in which it is resiliently retained by an associated one of said pair of biasing arrangements, said pair of latch hooks respectively engage said pair of hydraulic lift cylinders, whereby extension of said pair of hydraulic cylinders when detaching said pair of masts from said pair of upright members results in said pair of lift cylinders respectively moving said pair of latch hooks toward said closed position to the extent that said pair of biasing arrangements are moved over center so that the latter resiliently retain said pair of latch hooks in said closed positions so as to be ready for the next time that said masts are to be connected to said upright members.

5. The combination, as defined in claim 4, wherein said pair of latch hooks and said pair of hydraulic lift cylinders are respectively pivotally coupled to said pair of masts by a pair of coupling pins; and said pair of latch hooks respectively including a pair of abutments respectively located for contacting said pair of hydraulic lift cylinders when said pair of latch hooks are in said open position.

6. The combination, as defined in claim 5, wherein said pair of latch hooks are each defined by a pair of parallel side members disposed on opposite sides of an associated one of said pair of hydraulic lift cylinders; and one of said pair of abutments extending between said side members.

7. The combination, as defined in claim 1, wherein said pair of masts each include a pair of parallel side plates; and each of said pair of latch hooks being located between and pivotally coupled to said side plates of an associated one of said pair of masts.

8. The combination, as defined in claim 1, wherein each of said latch hooks includes a rear end section defined by a hook nose; and a toe pad being joined to said hook nose for providing a surface against which an operator may press his foot so as to pivot the associated latch hook from said closed position to said open position.

9. The combination, as defined in claim 1, wherein said pair of latch hooks respectively include a pair of rear surfaces located, when said pair of latch hooks are in respective closed positions, for being moved against said pair of latching elements upon said pair of masts being pivoted rearwardly about said pivot-defining elements during attachment of said masts to said upright members; and said pair of rear surfaces being so disposed relative to said pair of latching elements that said pair of latching elements are deflected upwardly from said closed positions with said latch hooks passing over said pair of latching elements, with the latching elements then becoming received in said pair of latching element receptacles.

10. The combination, as defined in claim 1, wherein said pair of support members are each a vertical support plate, with associated ones of said pair of pivot-defining elements and of said pair of latching elements having opposite ends located on opposite sides of an associated vertical support plate; said pair of masts each including a pair of transversely spaced, parallel side plates, with said pair of side plates respectively straddling said pair of support plates; and said pair of latch hooks being respectively located between said side plates of said pair of masts; and said pair of latch hooks being bifurcated so as to respectively straddle said pair of vertical support plates, when said pair of latch hooks are closed and respectively have said pair of latching elements received in said pair of latching element receptacles.

* * * * *